US009163862B2

(12) United States Patent
Munns et al.

(10) Patent No.: US 9,163,862 B2
(45) Date of Patent: Oct. 20, 2015

(54) RECEIVER FILL VALVE AND CONTROL METHOD

(75) Inventors: Scott A. Munns, Onalaska, WI (US); Ladislas T. Gbetoho, Nancy (FR); Jean-Michel M. Genay, Laneuvelotte (FR); William B. Fox, Onalaska, WI (US); George M. Singh, La Crosse, WI (US)

(73) Assignee: Trane International Inc., Piscataway, NJ (US)

( * ) Notice: Subject to any disclaimer, the term of this patent is extended or adjusted under 35 U.S.C. 154(b) by 1313 days.

(21) Appl. No.: 12/807,894

(22) Filed: Sep. 16, 2010

(65) Prior Publication Data

US 2012/0067068 A1 Mar. 22, 2012

(51) Int. Cl.

| | |
|---|---|
| ***F25B 41/00*** | (2006.01) |
| ***F25B 13/00*** | (2006.01) |
| ***F25B 47/02*** | (2006.01) |

(52) U.S. Cl.

CPC ..... *F25B 13/00* (2013.01); *F25B 47/02* (2013.01); *F25B 2313/02741* (2013.01); *F25B 2341/066* (2013.01); *F25B 2400/16* (2013.01); *F25B 2500/03* (2013.01); *F25B 2500/28* (2013.01); *F25B 2600/2513* (2013.01); *F25B 2600/2523* (2013.01)

(58) Field of Classification Search

CPC ..... F25B 47/025; F25B 41/046; F25B 2600/2523

USPC ..... 62/324.5–324.6, 151, 81, 140, 234

See application file for complete search history.

(56) References Cited

U.S. PATENT DOCUMENTS

| | | | | |
|---|---|---|---|---|
| 4,528,822 | A | 7/1985 | Glamm | |
| 4,546,616 | A | 10/1985 | Drucker | |
| 5,259,213 | A | 11/1993 | Phillippe | |
| 6,170,277 | B1 * | 1/2001 | Porter et al. | 62/228.3 |
| 6,644,066 | B1 * | 11/2003 | Dolcich | 62/509 |
| 7,171,817 | B2 * | 2/2007 | Birgen | 62/81 |
| 7,484,374 | B2 * | 2/2009 | Pham et al. | 62/81 |

* cited by examiner

*Primary Examiner* — Cheryl J Tyler
*Assistant Examiner* — Orlando Aviles Bosques
(74) *Attorney, Agent, or Firm* — William O'Driscoll

(57) ABSTRACT

A heat pump includes a valve system that connects a receiver tank in fluid communication with an indoor heat exchanger, wherein the valve system, operating under a novel control scheme, works in conjunction with the receiver to control the heat pump's effective refrigerant charge. To avoid suction or discharge pressure faults and to help prevent slugs of liquid refrigerant from entering the heat pump's compressor as the heat pump switches between heating and cooling modes or switches between heating and defrost modes, the control scheme provides momentary periods of transition between those modes of operation. In some embodiments, the valve system comprises a check valve connected in parallel flow relationship with a two-position receiver valve, wherein the check valve has an appreciably higher flow coefficient than that of the receiver valve.

8 Claims, 6 Drawing Sheets

RECEIVER FILL VALVE AND CONTROL METHOD

BACKGROUND OF THE INVENTION

1. Field of the Invention

The subject invention generally pertains to reversible heat pump systems and more specifically to a system and method for managing the effective refrigerant charge while operating within or transitioning between various operating modes.

2. Description of Related Art

Compression refrigerant heat pumps with indoor and outdoor heat exchangers are operable selectively in heating and cooling modes. When the outdoor heat exchanger is air cooled (i.e., air cooled when the outdoor heat exchanger is condensing refrigerant therein), the heating mode may need to be periodically interrupted to defrost the outdoor heat exchanger by momentarily running the heat pump in a defrost mode.

Shifting from one operating mode to another can cause suction or discharge pressure faults and can cause slugs of liquid refrigerant to enter the compressor, which can damage the compressor. Consequently, there is a need for addressing the problems that occur when a heat pump changes modes of operation.

SUMMARY OF THE INVENTION

It is an object of some embodiments of the invention to provide a heat pump that avoids refrigerant pressure faults while changing from one operating mode to another.

Another object of some embodiments is to provide a heat pump that helps prevent liquid slugs of refrigerant from being drawn into a compressor.

Another object of some embodiments is to provide a heat pump that adjusts the effective refrigerant charge to meet the changing needs of the heat pump during heating, cooling and defrost modes of operation.

Another object of some embodiments is to convey refrigerant to and from a receiver via a check valve and a two-position valve, wherein the two valves have relative flow coefficients that provide a balanced solution to somewhat conflicting concerns such as valve cost, flow rate through the receiver during the heating mode, and flow rate from the receiver during the cooling or defrost mode.

In some embodiments the present invention provides a heat pump containing a refrigerant and being selectively operable in a cooling mode, a heating mode, a defrost mode, and a transition mode, wherein the transition mode occurs as the heat pump transitions from the defrost mode. The heat pump comprises a compressor connected to convey the refrigerant from a suction line to a discharge line; an outdoor heat exchanger installed between an outdoor line-A and an outdoor line-B; an indoor heat exchanger installed between an indoor line-A and an indoor line-B; a receiver; a heating expansion valve connected in fluid communication between the receiver and the outdoor line-B; a cooling expansion valve connected in fluid communication between the outdoor line-B and the indoor line-A; and a valve system connected in fluid communication between the indoor line-A and the receiver, wherein the valve system comprises a check valve and a receiver valve that are in parallel flow relationship with each other. The heat pump further comprises a directional valve connected in fluid communication with the suction line, the discharge line, the outdoor line-A, and the indoor line-B, wherein the directional valve is movable to selectively direct refrigerant flow through the heat pump. In the cooling mode and the defrost mode, the indoor heat exchanger conveys the refrigerant from the indoor line-A to the indoor line-B, the outdoor heat exchanger conveys the refrigerant from the outdoor line-A to the outdoor line-B, the cooling expansion valve is open to convey the refrigerant from the outdoor line-B to the indoor line-A, the heating expansion valve is substantially closed, and the valve system places the receiver in substantially open fluid communication with the indoor line-A. In the heating mode, the indoor heat exchanger conveys the refrigerant from the indoor line-B to the indoor line-A, the outdoor heat exchanger conveys the refrigerant from the outdoor line-B to the outdoor line-A, the cooling expansion valve is substantially closed, the heating expansion valve is open to convey the refrigerant from the receiver to the outdoor line-B, and the valve system places the receiver in substantially open fluid communication with the indoor line-A. In the transition mode, which occurs as the heat pump transitions from the defrost mode, the indoor heat exchanger conveys the refrigerant from the indoor line-A to the indoor line-B, the outdoor heat exchanger conveys the refrigerant from the outdoor line-A to the outdoor line-B, the cooling expansion valve conveys the refrigerant from the outdoor line-B to the indoor line-A, the heating expansion valve is open to allow the refrigerant to migrate from the outdoor line-B into the receiver, and the valve system is substantially closed to obstruct flow from the receiver to the indoor line-A.

In some embodiments the present invention provides a method for controlling a heat pump selectively operable in a heating mode, wherein the heat pump includes an indoor heat exchanger, an outdoor heat exchanger, a compressor compressing a refrigerant, a receiver, a heating expansion valve, a cooling expansion valve, a check valve, and a receiver valve. The heating expansion valve connects the outdoor heat exchanger in fluid communication with the receiver, the cooling expansion valve connects the indoor heat exchanger in fluid communication with the outdoor heat exchanger, and the check valve and the receiver valve are connected in parallel flow relationship with each other to convey the refrigerant between the indoor heat exchanger and the receiver. The method for controlling the heat pump comprises initiating operation of the heat pump in the heating mode by running the compressor while both the check valve and the receiver valve are substantially closed; opening the check valve to convey the refrigerant at a first mass flow rate from the indoor heat exchanger to the receiver; and after opening the check valve, opening the receiver valve to convey the refrigerant at a second mass flow rate from the indoor heat exchanger to the receiver, wherein the second mass flow rate is greater than the first mass flow rate.

In some embodiments the present invention provides a method for controlling a heat pump selectively operable in a heating mode, a defrost mode, and a transition mode, wherein the heat pump includes an indoor heat exchanger, an outdoor heat exchanger, a compressor compressing a refrigerant, a receiver, a heating expansion valve, a cooling expansion valve, a directional valve, a check valve, and a receiver valve. The directional valve determines a direction of flow through the indoor heat exchanger and the outdoor heat exchanger, the heating expansion valve connects the outdoor heat exchanger in fluid communication with the receiver, the cooling expansion valve connects the indoor heat exchanger in fluid communication with the outdoor heat exchanger, and the check valve and the receiver valve are connected in parallel flow relationship with each other to convey the refrigerant between the indoor heat exchanger and the receiver. The method for controlling the heat pump comprises operating the heat pump in the heating mode by releasing heat from the indoor heat exchanger and absorbing heat into the outdoor heat exchanger; and after the heating mode, operating the heat pump in the defrost mode by opening the cooling expansion valve and releasing heat from the outdoor heat exchanger; and then transitioning out of the defrost mode via a transition mode by releasing heat from the outdoor heat exchanger, closing the receiver valve to inhibit the refrigerant from flowing from the receiver to the indoor heat exchanger, and opening the heating expansion valve while the cooling expansion valve is still open.

DESCRIPTION OF THE PREFERRED EMBODIMENT

Figure 1:
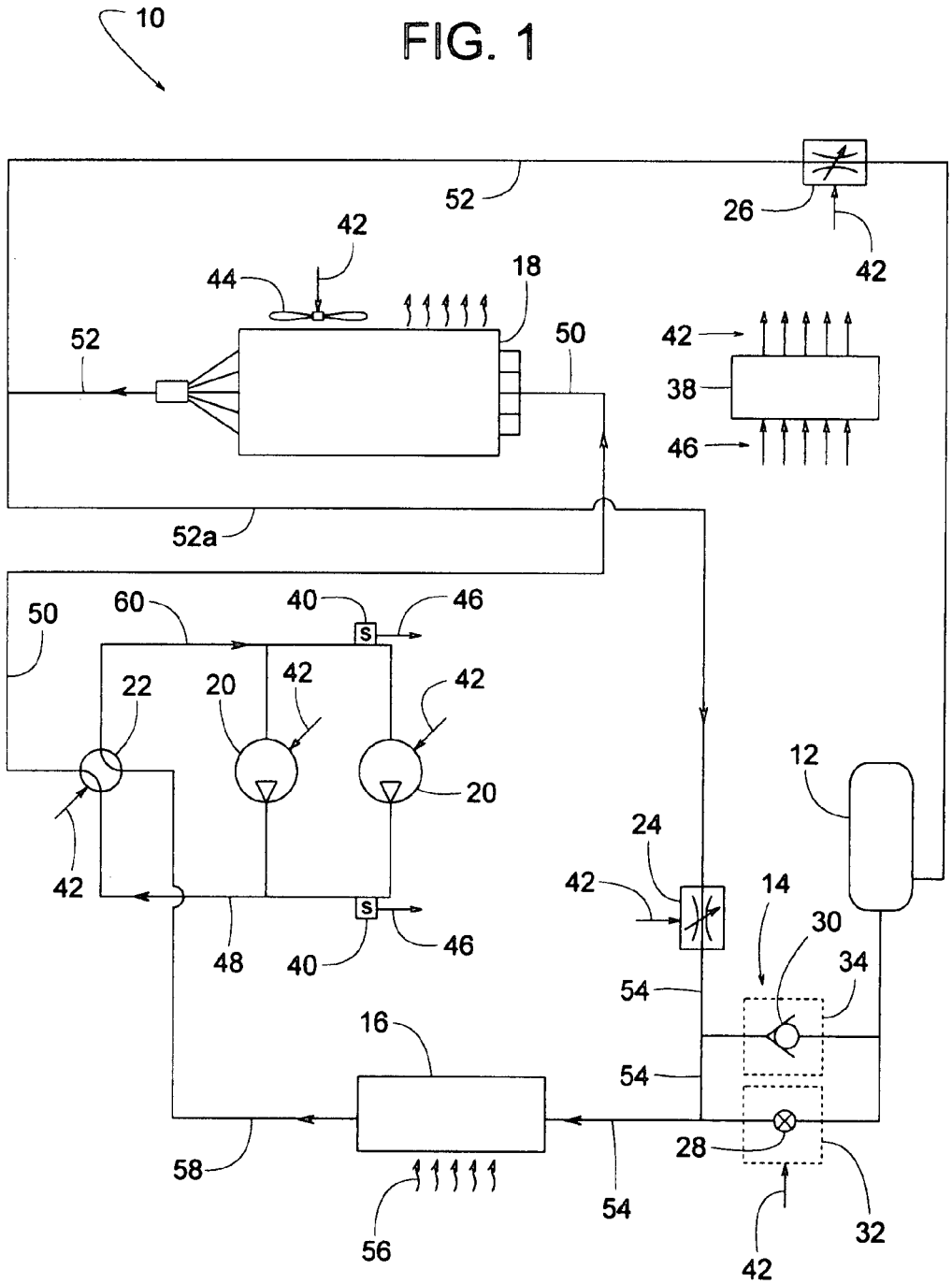
FIG. 1 is a schematic diagram of a heat pump according to one example of the present invention with the heat pump operating in a cooling or defrost mode.
Figure 2:
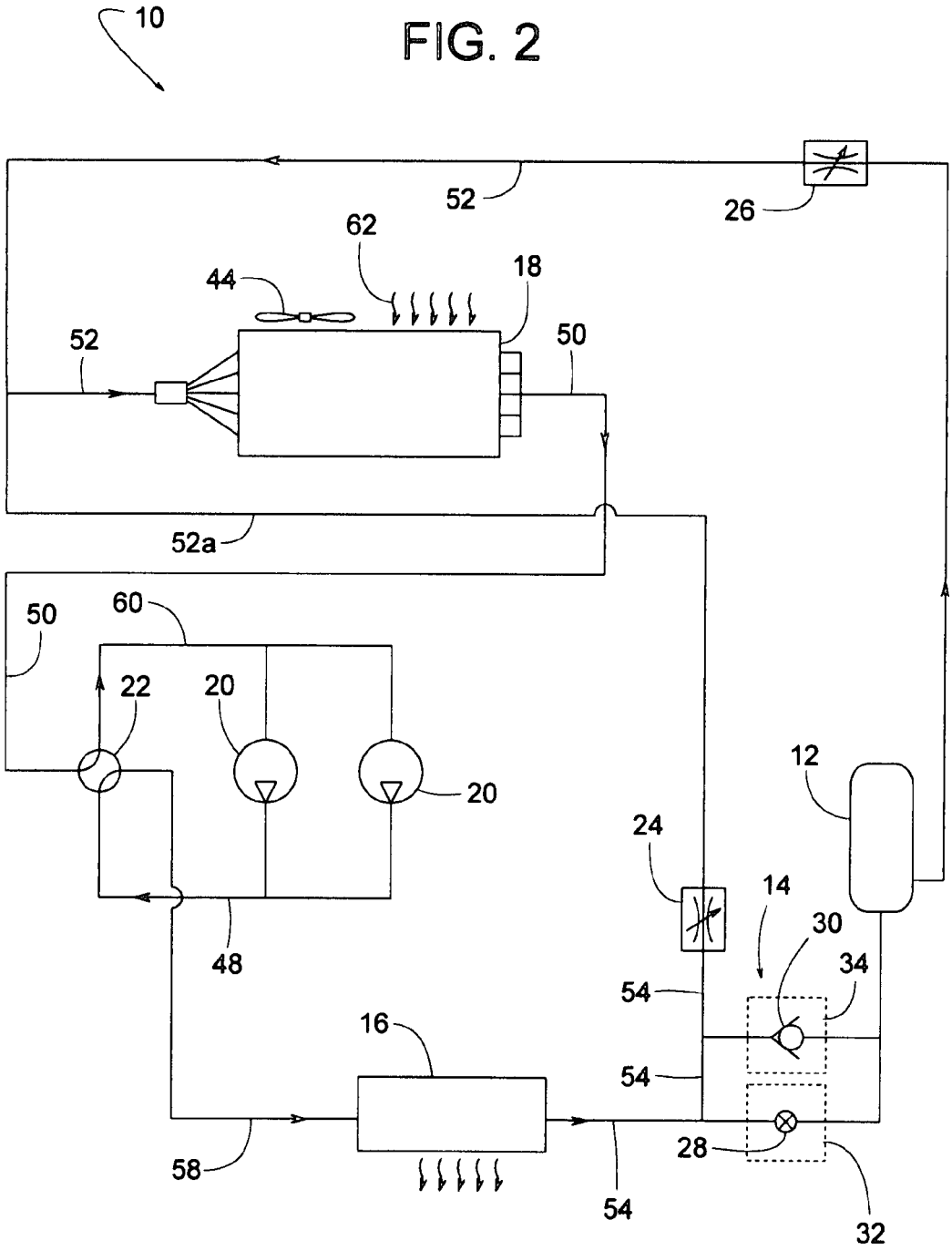
FIG. 2 is a schematic diagram of the heat pump of FIG. 1 but showing the heat pump in a heating mode.

FIGS. 1 and 2 show one example of a heat pump 10 that includes a receiver 12 and a valve system 14 for controlling the heat pump's effective refrigerant charge while operating within or transitioning between various operating modes. The operating modes include one or more of the following: a cooling mode for cooling a comfort zone via an indoor heat exchanger 16, a heating mode for heating the comfort zone via indoor heat exchanger 16, a defrost mode for defrosting an outdoor heat exchanger 18, and one or more transition modes that occur as heat pump 10 transitions between cooling, heating and defrost modes.

In some examples, the cooling mode is substantially the same as the defrost mode. The term, "heat pump" means any compression refrigerant system with at least two heat exchangers, each of which can selectively condense or evaporate the refrigerant depending on how the refrigerant is directed through the system. The terms, "indoor" and "outdoor" refer to components associated with exchanging heat (directly or indirectly) with air or some other fluid generally associated with an environment that is inside (indoor) or outside (outdoor). The terms, "indoor" and "outdoor" do not necessarily mean the related heat exchanger or component is actually physically disposed inside or outside a building.

For the illustrated examples, indoor heat exchanger 16 is schematically illustrated to represent one or more heat exchangers that exchange heat with an indoor comfort zone, such as a room or other area of a building. Outdoor heat exchanger 18, in this example, is air cooled to exchange heat with the outdoor environment. The expression, "air cooled" as used herein refers to a heat exchanger being cooled by air when the heat exchanger is operating in a mode to condense refrigerant. In addition to heat exchangers 16 and 18, receiver 12, and valve system 14, heat pump 10 comprises one or more refrigerant compressors 20, a directional valve 22, a cooling expansion valve 24 and a heating expansion valve 26.

Figure 3:
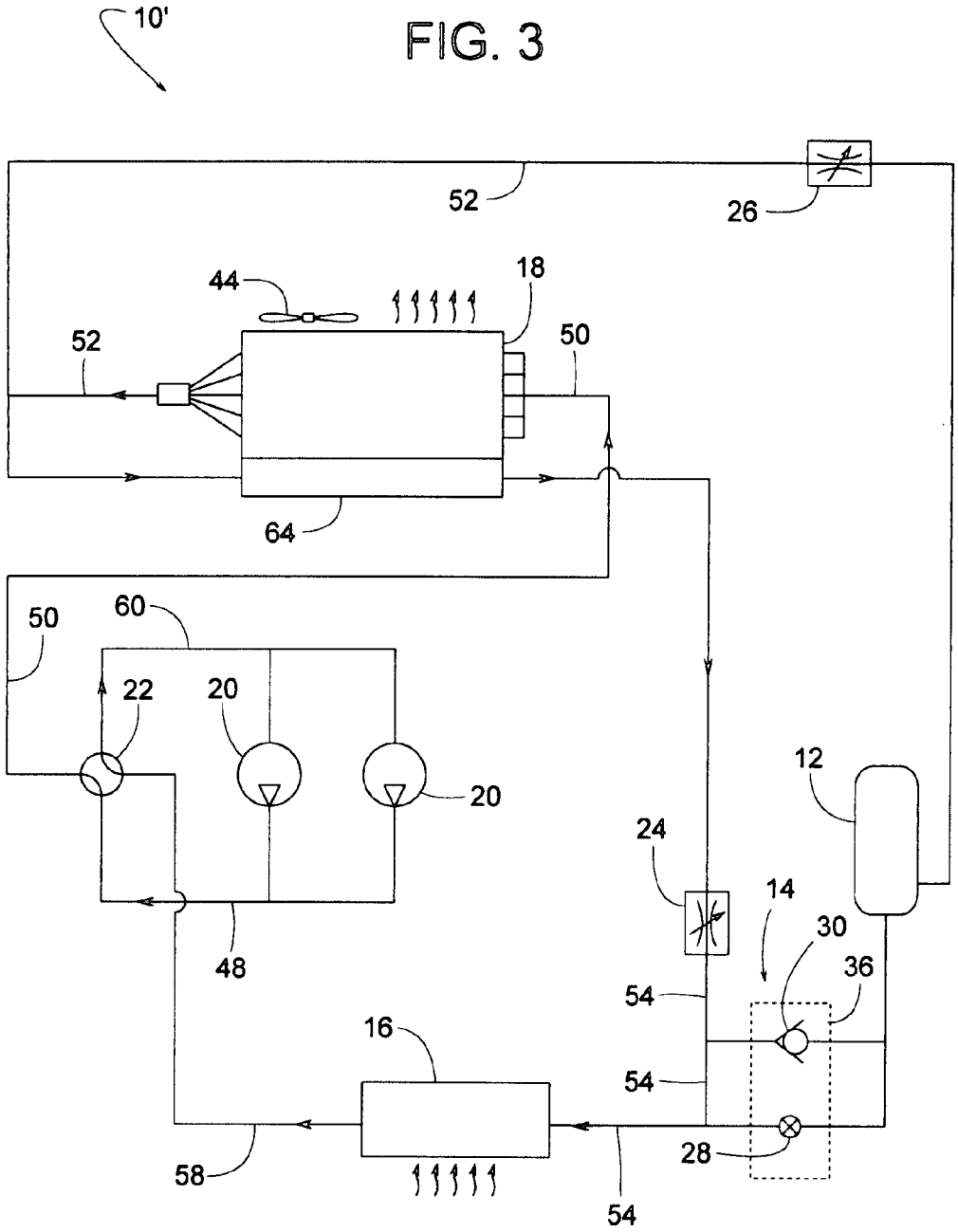
FIG. 3 is a schematic diagram similar to FIG. 1 but showing another example heat pump.
Figure 4:
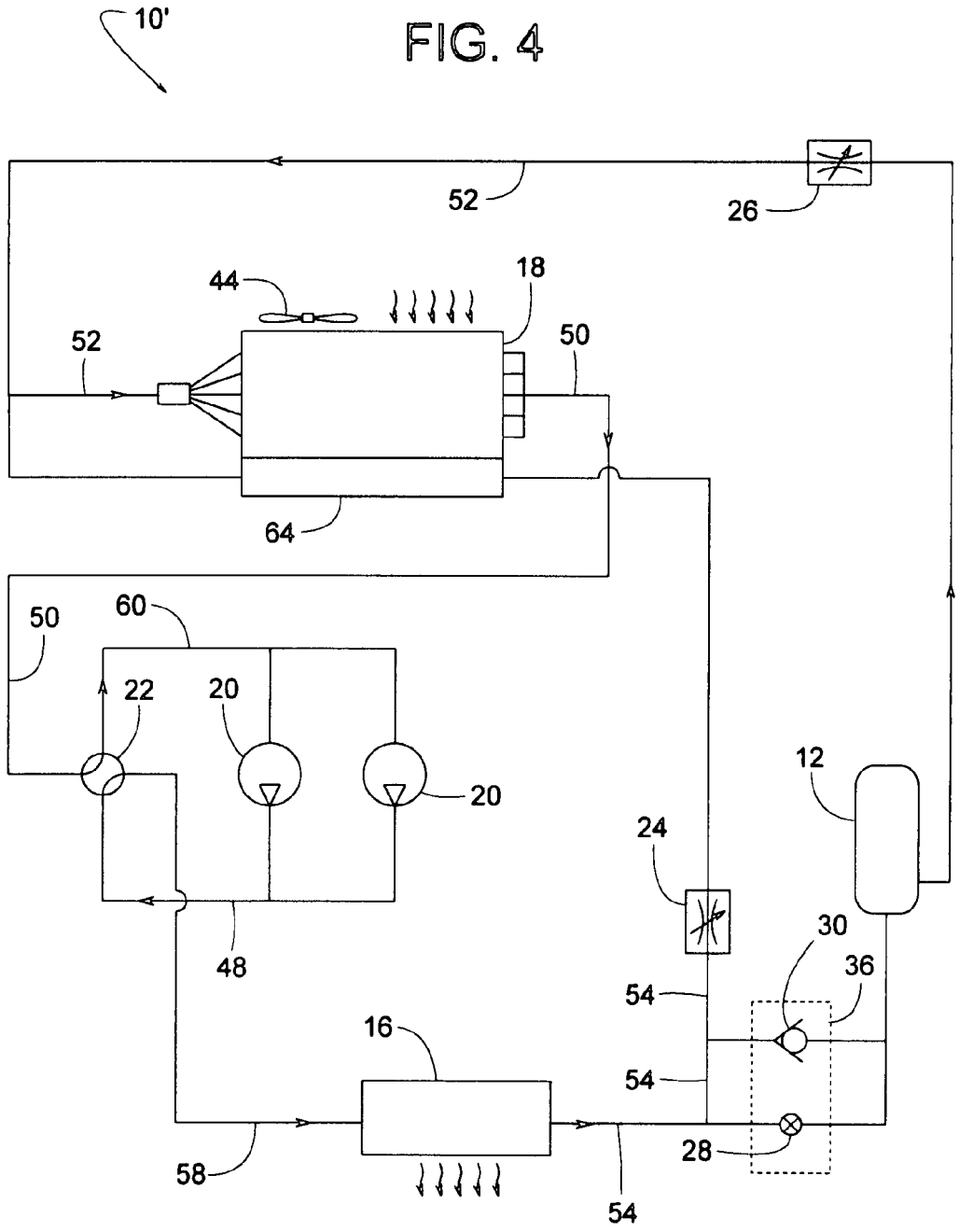
FIG. 4 is a schematic diagram of the heat pump of FIG. 3 but showing the heat pump in a heating mode.

In the illustrated example, valve system 14 comprises a receiver valve 28 and a check valve 30. In some examples, receiver valve 28 is a two-position solenoid actuated valve with pilot assist. Receiver valve 28 is movable selectively to an open position and a closed position. Other examples of valve 28 include, but are not limited to, a variable-open position valve, a solely fluid actuated valve, a motor actuated valve, etc. For simplicity, in some examples, valves 28 and 30 are discrete items with their own valve housings 32 and 34, respectively. In other examples, for compactness, valves 28 and 30 are combined in a single common valve housing 36, as shown in FIGS. 3 and 4. For reasons that will be explained later, receiver valve 28, in some embodiments, has a maximum flow coefficient that is less than that of check valve 30.

Figure 5:
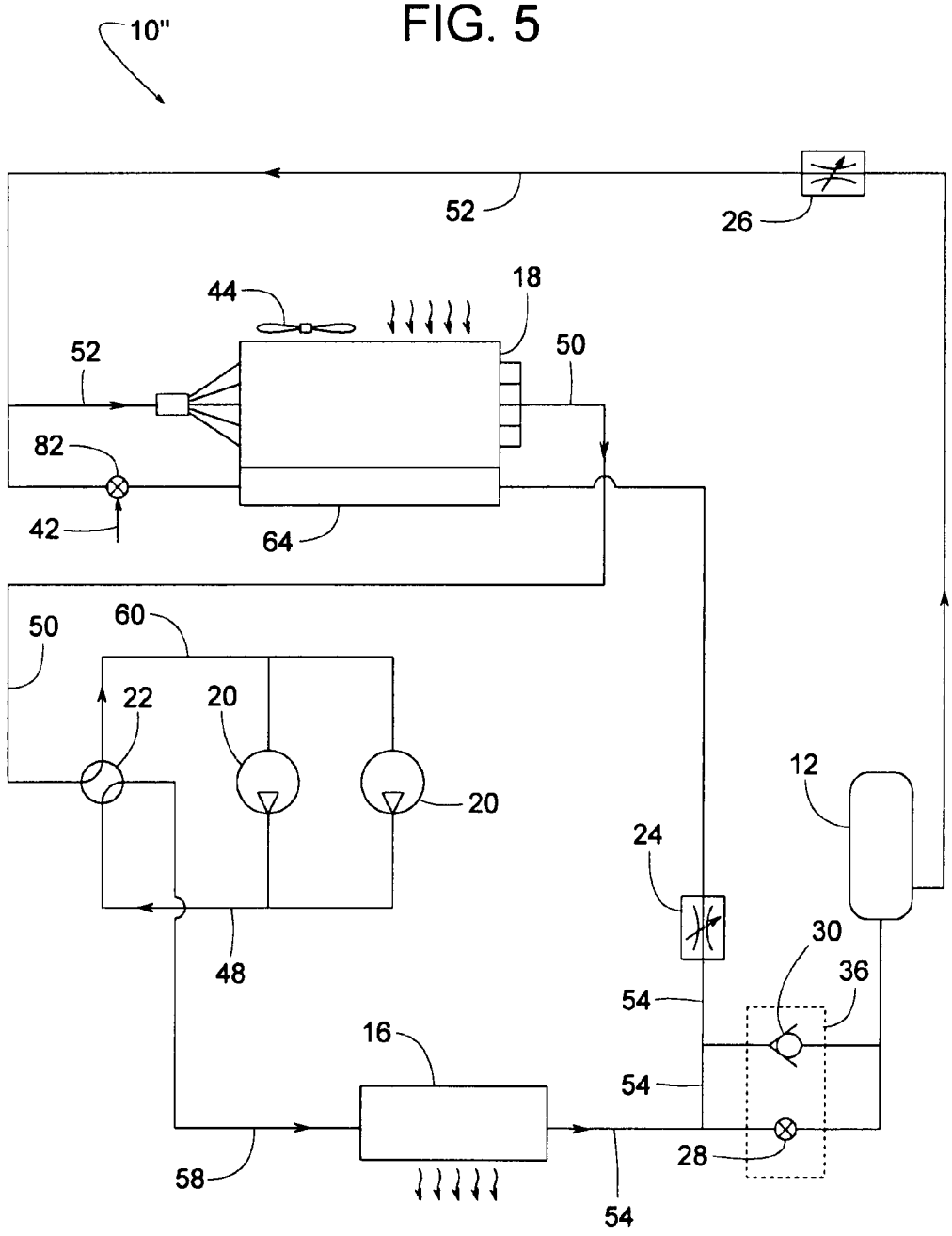
FIG. 5 is a schematic diagram similar to FIG. 4 but showing another example heat pump.

Heat pump 10 also includes a controller 38 responsive to one or more inputs 46 from one or more sensors 40 for generating one or more outputs 42 that control the operation of compressor 20, a fan system 44 (one or more fans) associated with outdoor heat exchanger 18, directional valve 22, expansion valves 24 and 26, valve system 14, and/or other components, e.g., a valve 82, shown in FIG. 5. Examples of sensor 40 include, but are not limited to, a temperature sensor and a pressure sensor. In some embodiments, sensors 40 sense the suction and/or discharge pressure of compressor 20.

When operating in the cooling or defrost mode, as shown in FIG. 1, directional valve 22 directs relatively hot gaseous refrigerant from a compressor discharge line 48 to an outdoor line-A 50 leading to outdoor heat exchanger 18. As refrigerant from outdoor line-A 50 passes through outdoor heat exchanger 18 to an outdoor line-B 52, the refrigerant releases its heat to the outside air and condenses within outdoor heat exchanger 18. When operating in the defrost mode, the heat from the condensing refrigerant is what defrosts outdoor heat exchanger 18.

During initial and normal operation in the cooling or defrost mode, heating expansion valve 26 is closed, so refrigerant from outdoor line-B 52 flows through cooling expansion valve 24. Upon passing through cooling expansion valve 24, the refrigerant decreases in pressure and cools by expansion. The relatively cool low pressure refrigerant enters indoor heat exchanger 16 through an indoor line-A 54. At this point, receiver valve 28 is open, so any liquid refrigerant in receiver 12 is drawn through receiver valve 28 into the relatively low pressure indoor line-A 54. In some embodiments of the invention, controller 38 commands valve 28 to open at a predetermined time after starting the heating mode, e.g., after about five minutes, because otherwise a high pressure differential across a closed receiver valve 28 at the beginning of the defrost mode might make it difficult for valve 28 to open. As refrigerant from indoor line-A 54 passes through indoor heat exchanger 16, the refrigerant absorbs heat 56 from the comfort zone and vaporizes prior to exiting heat exchanger 16 through an indoor line-B 58. Directional valve 22 directs the refrigerant from indoor line-B 58 to a suction line 60 of compressor 20, thus perpetuating the cooling or defrost cycle.

Near the end of a cooling or defrost cycle, heat pump 10 shifts to the transition mode prior to de-energizing compressor 20 or prior to initiating a heating cycle. In the transition mode, liquid refrigerant is directed to accumulate in receiver 12 to reduce the amount of liquid refrigerant in outdoor heat exchanger 18. Otherwise, excess liquid refrigerant in outdoor heat exchanger 18 can lead to high pressure faults due to refrigerant buildup in indoor heat exchanger 16 upon restarting the heating mode. Also, upon heating mode startup, excess liquid refrigerant in outdoor heat exchanger 18 could flow into and damage compressor 20.

To change from the cooling or defrost mode to the transition mode, heating expansion valve 26 opens and receiver valve 28 closes while at least one compressor 20 continues running. This allows receiver 12 to be pressurized to just below the pressure of outdoor heat exchanger 18. The pressure gradient between outdoor heat exchanger 18 and receiver 12 and the relatively cold wall temperature of receiver 12 encourages refrigerant to migrate from outdoor heat exchanger 18 to receiver 12 and condense there, partially filling receiver 12 with liquid refrigerant.

Various trigger signals can be used for terminating the transition mode. Examples of such trigger signals include, but are not limited to, a predetermined duration of the transition mode (e.g., 45 seconds), sensor 40 sensing that the compressor's discharge pressure increased to a predetermined upper limit, and sensor 40 sensing that the compressor's suction pressure decreased to a predetermined lower limit. After terminating the transition mode, heat pump 10 can be deactivated by de-energizing compressor 20, or heat pump 10 can be switched to operating in the heating mode.

In the heating mode, shown in FIG. 2, heating expansion valve 26 is open, cooling expansion valve 24 is closed, and directional valve 22 directs relatively hot gaseous refrigerant from discharge line 48 to indoor line-B 58 leading to indoor heat exchanger 16. As refrigerant from indoor line-B 58 passes through indoor heat exchanger 16 to indoor line-A 54, the refrigerant releases its heat to the comfort zone and condenses within indoor heat exchanger 16.

Initially and until the pressure in indoor line-A 54 builds up, check valve 30 and receiver valve 28 are closed. When the pressure in indoor line-A 54 exceeds the pressure in receiver 12, check valve 30 opens to convey refrigerant from indoor line-A 54 to receiver 12. At a predetermined time after starting the heating mode, e.g., after about five minutes, receiver valve 28 opens to slightly reduce the flow resistance between indoor line-A 54 and receiver 12. Thus, opening receiver valve 28 provides valve system 14 with a higher flow coefficient than when check valve 30 is open while receiver valve 28 is closed.

From receiver 12, the refrigerant flows through heating expansion valve 26, thereby decreasing in pressure and cooling by expansion. The relatively cool low pressure refrigerant enters outdoor heat exchanger 18 through outdoor line-B 52. As refrigerant from outdoor line-B 52 passes through outdoor heat exchanger 18, the refrigerant absorbs heat 62 from the outside ambient air and vaporizes prior to exiting heat exchanger 18 through outdoor line-A 50. Directional valve 22 directs the refrigerant from outdoor line-A 50 to suction line 60 of compressor 20, thus perpetuating the heating cycle.

Upon switching from the heating mode to the cooling or defrost mode, receiver valve 28 is open. So, as mentioned earlier, any liquid refrigerant that happens to be in receiver 12 is drawn through receiver valve 28 into the relatively low pressure indoor line-A 54. To prevent receiver valve 28 from conveying an excessive inrush of liquid refrigerant from receiver 12 to indoor heat exchanger 16, receiver valve 28 preferably provides appreciable flow resistance. In the heating mode, the flow resistance of check valve 30 should be as low as reasonably possible. To balance the various flow needs during the cooling, heating and defrost modes, the flow resistance of receiver valve 28 preferably is greater than that of open check valve 30.

In some embodiments, shown in FIGS. 3 and 4, a heat pump 10' includes a subcooler heat exchanger 64 added to outdoor heat exchanger 18 to ensure complete condensation of refrigerant before the refrigerant enters cooling expansion valve 24 in the cooling mode. Instead of a direct line 52*a* connecting outdoor line-B 52 in fluid communication with cooling expansion valve 24, as shown in FIGS. 1 and 2, subcooler 64 connects outdoor line-B 52 in fluid communication with cooling expansion valve 24, as shown in FIGS. 3 and 4. Otherwise, heat pumps 10 and 10' are basically the same in structure and function.

In an example similar to heat pump 10', shown in FIG. 5, a heat pump 10" includes a subcooler valve 42 in addition to subcooler 64. In this example, subcooler valve 42 is open during the cooling and defrost modes, so heat pumps 10' and 10" operate generally the same way during the cooling and defrost modes. During the heating mode, however, subcooler valve 42 is closed while cooling expansion valve 24 is partially open. Cooling expansion valve 24 being at least partially open allows refrigerant to migrate into subcooler 64 and accumulate there as a liquid during the heating mode.

Figure 6:
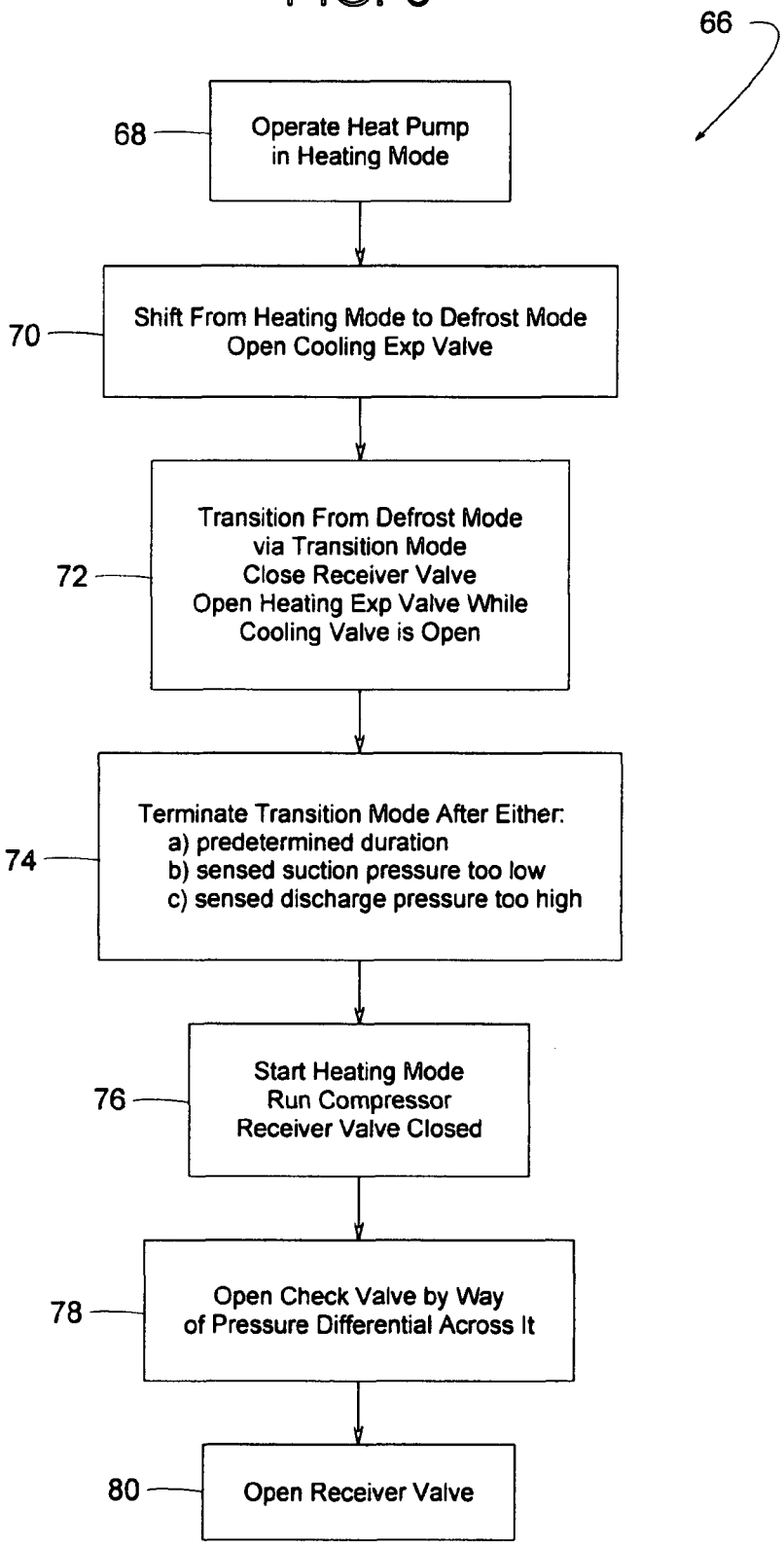
FIG. 6 is a block diagram of a control algorithm.

The aforementioned methods of operating and controlling heat pumps 10, 10' and 10" are illustrated in FIG. 6, which shows an example algorithm 66 under which controller 38 operates. Control block 68 illustrates operating the heat pump in the heating mode by releasing heat from the indoor heat exchanger and absorbing heat into the outdoor heat exchanger. Control block 70 illustrates: after the heating mode, operating the heat pump in the defrost mode by opening the cooling expansion valve and releasing heat from the outdoor heat exchanger. Control block 72 illustrates transitioning out of the defrost mode via a transition mode by releasing heat from the outdoor heat exchanger, closing the receiver valve to inhibit the refrigerant from flowing from the receiver to the indoor heat exchanger, and opening the heating expansion valve while the cooling expansion valve is still open. Control block 74 illustrates terminating the transition mode after either a) a predetermined duration of operation, b) if the sensed suction pressure decreases to a predetermined lower limit, or c) if the sensed discharge pressure increases to a predetermined upper limit. Control block 76 illustrates initiating operation of the heat pump in the heating mode by running the compressor while both the check valve and the receiver valve are substantially closed initially. Control block 78 illustrates: during the heating mode, opening the check valve to convey the refrigerant at a first mass flow rate from the indoor heat exchanger to the receiver. Control block 80 illustrates: after opening the check valve, opening the receiver valve to convey the refrigerant at a second mass flow rate from the indoor heat exchanger to the receiver, wherein the second mass flow rate is greater than the first mass flow rate.

Although the invention is described with respect to a preferred embodiment, modifications thereto will be apparent to those of ordinary skill in the art. In some embodiments, for example, heat pumps 10, 10' and 10" include various service isolation valves. The scope of the invention, therefore, is to be determined by reference to the following claims:

The invention claimed is:

1. A method for controlling a heat pump selectively operable in a heating mode, a defrost mode, and a transition mode, the heat pump includes an indoor heat exchanger, an outdoor heat exchanger, a compressor compressing a refrigerant, a receiver, a heating expansion valve, a cooling expansion valve, a directional valve, a check valve, and a receiver valve, the directional valve determines a direction of flow through the indoor heat exchanger and the outdoor heat exchanger, the heating expansion valve connects the outdoor heat exchanger in fluid communication with the receiver, the cooling expansion valve connects the indoor heat exchanger in fluid communication with the outdoor heat exchanger, and the check valve and the receiver valve are connected in parallel flow relationship with each other to convey the refrigerant between the indoor heat exchanger and the receiver, the method comprising:

operating the heat pump in the heating mode by releasing heat from the indoor heat exchanger and absorbing heat into the outdoor heat exchanger;

after the heating mode, operating the heat pump in the defrost mode by opening the cooling expansion valve and releasing heat from the outdoor heat exchanger; and transitioning out of the defrost mode and back to the heating mode via a transition mode, wherein said transition mode comprises the steps of (a) releasing heat form the outdoor heat exchanger, (b) opening the heating expansion valve and closing the receiver valve while the compressor continues running; wherein the step of closing the receiver valve prohibits the refrigerant from flowing from the receiver to the indoor heat exchanger and wherein the step of opening the heating expansion valve is performed while the cooling expansion valve is still open; and wherein said steps of the transitioning mode occur after the defrost mode and prior initiating the heating mode.

2. The method of claim 1, further comprising:

initiating operation of the heat pump in the heating mode by running the compressor while both the check valve and the receiver valve are closed;

during the heating mode, opening the check valve to convey the refrigerant from the indoor heat exchanger to the receiver; and after opening the check valve, increasing a flow coefficient of a valve system by opening the receiver valve to assist the check valve in conveying the refrigerant from the indoor heat exchanger to the receiver, wherein the valve system comprises the check valve and the receiver valve connected in parallel flow relationship with each other.

3. The method of claim 1, wherein the check valve has a maximum flow coefficient that is greater than that of the receiver valve.

4. The method of claim 1, wherein the receiver valve and the check valve share a common valve housing.

5. The method of claim 1, further comprising terminating the transition mode after a predetermined duration of operation.

6. The method of claim 1, further comprising:

sensing a suction pressure of the heat pump; and terminating the transition mode if the suction pressure decreases to a predetermined lower limit.

7. The method of claim 1, further comprising:

sensing a discharge pressure of the heat pump; and terminating the transition mode if the discharge pressure increases to a predetermined upper limit.

8. The method of claim 1, further comprising:

terminating the transition mode; and closing the heating expansion valve upon terminating the transition mode.

* * * * *